United States Patent [19]

Williams

[11] Patent Number: 4,478,034

[45] Date of Patent: Oct. 23, 1984

[54] LOCK MECHANISM FOR WIRE STRANDING MACHINE

[75] Inventor: Dean L. Williams, Rome, N.Y.

[73] Assignee: M.G.S. Mfg. Inc., Rome, N.Y.

[21] Appl. No.: 503,188

[22] Filed: Jun. 10, 1983

[51] Int. Cl.[3] ..... D07B 7/06

[52] U.S. Cl. ..... 57/58.34

[58] Field of Search ..... 57/58.32, 58.34; 242/129.6, 68.4

[56] References Cited

U.S. PATENT DOCUMENTS

| | | | |
|---|---|---|---|
| 407,522 | 7/1889 | Furst | 57/58.34 |
| 1,423,766 | 7/1922 | Morrison | 57/58.34 |
| 1,855,877 | 4/1932 | Blood et al. | 242/129.6 |
| 2,445,261 | 7/1948 | Bruestle | 57/58.34 |
| 2,485,348 | 10/1949 | Arnason | 57/58.34 |
| 2,664,693 | 1/1954 | Bruestle | 57/58.34 |
| 4,208,864 | 6/1980 | Kaes | 57/58.34 |

*Primary Examiner*—Donald Watkins

*Attorney, Agent, or Firm*—Bruns and Wall

[57] ABSTRACT

A releasable lock mechanism for securing a spool of wire in its supporting cradle in a tubular type wire stranding machine. The mechanism is both positive in action and easy to operate and includes for each end of the spool shaft a generally sector shaped locking member that is movable into and out of a position overlying the end of the shaft. When the locking member is moved into its locking position overlying the end of the spool shaft, it is positively yet releasably held in this position by coacting detent means on the member and cradle side rail.

6 Claims, 6 Drawing Figures

LOCK MECHANISM FOR WIRE STRANDING MACHINE

BACKGROUND OF THE INVENTION

This invention relates generally to wire stranding machines, and has particular reference to a novel lock mechanism for positively yet releasably securing a spool of wire in its supporting cradle in a tubular type stranding machine.

Tubular type stranding machines, also known as Larmuth type, have been in use for many years and are well known. In these machines, the strander tube is supported by bearings or rollers and is rotated under power about its longitudinal axis. Within the tube spools of single strand wire are rotatably mounted in cradles and the cradles in turn are supported by bearings at each end, the bearings being coaxial with the tube axis. The cradles are weighted at the bottom and therefore remain stationary when the tube rotates.

The strander tube typically rotates in excess of 2000 R.P.M. and for this reason it is imperative that the individual spools be securely locked in their cradles. A failure that permitted a spool to escape from its cradle and contact the inside of the tube would result in very serious damage to the machine. It will be apparent, therefore, that there exists a need for a positive lock mechanism for securing a spool of wire in its supporting cradle in a wire stranding machine. Because the machine operator must load and unload the spools through openings in the tube side wall, it will be apparent also that a lock mechanism that is easy to operate is also very desirable.

The closest prior art known to the applicant is disclosed in U.S. Pat. No. 407,522, issued July 23, 1889 to M. Furst for a Machine For Making Rope. In this patent, the ends of a spindle carrying a bobbin are held in place by overlying arms that are spring biased into locking position. The springs, however, do not provide a positive lock and it is doubtful if the patented lock mechanism could be relied upon in a machine rotating at the high speeds of present day wire stranding machines.

Other pertinent patents, noted in the course of a preliminary search, are U.S. Pat. Nos. 1,378,932; 1,423,776; 1,495,144; 1,636,466; 2,485,348; 2,567,329 and 4,241,573. The lock mechanisms and devices shown in these patents are for the most part relatively complex.

SUMMARY OF THE INVENTION

The present invention provides a releasable lock mechanism for securing a spool of wire in its supporting cradle in a tubular type wire stranding machine. The mechanism is both positive in action and easy to operate and includes for each end of the spool shaft a generally sector shaped locking member that is movable into and out of a position overlying the end of the shaft. The locking member is pivotally connected near its upper end to a suitable support mounted on a side rail of the cradle and means are provided to limit the amount of pivotal movement that is permitted.

When the locking member is moved into its locking position overlying the end of the spool shaft, it is positively yet releasable held in this position by coacting detent means on the member and cradle side rail.

DESCRIPTION OF THE PREFERRED EMBODIMENT

Figure 1:
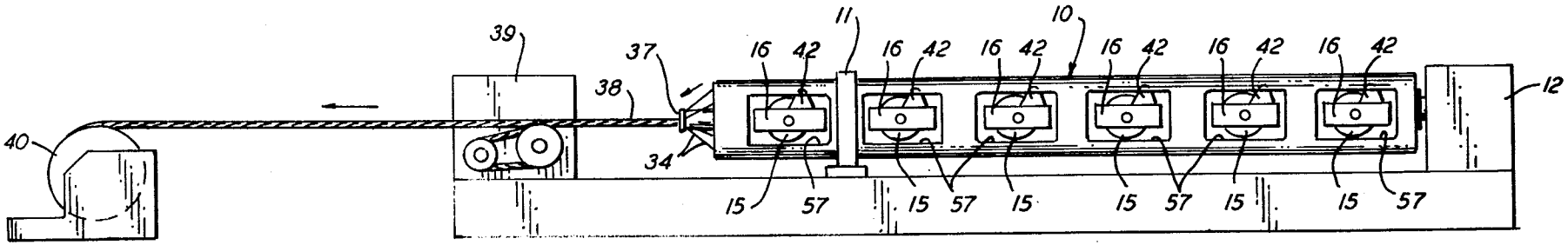
FIG. 1 is a diagrammatic side elevation of a tubular type wire stranding machine.

Referring now to the drawings, and with particular reference to FIG. 1, the tubular type wire stranding machine that is diagrammatically illustrated includes a tube 10 that is disposed horizontally and supported by suitable bearings or rollers (not shown) located in a stanchion 11 and motor housing 12. A motor (not shown) located in the housing 12 operates to rotate the tube at high speeds. Tube 10 is divided into a series of individual compartments 14 each of which contains a spool 15 of single strand wire and a cradle 16 in which the spool is rotatably mounted.

Figure 2:
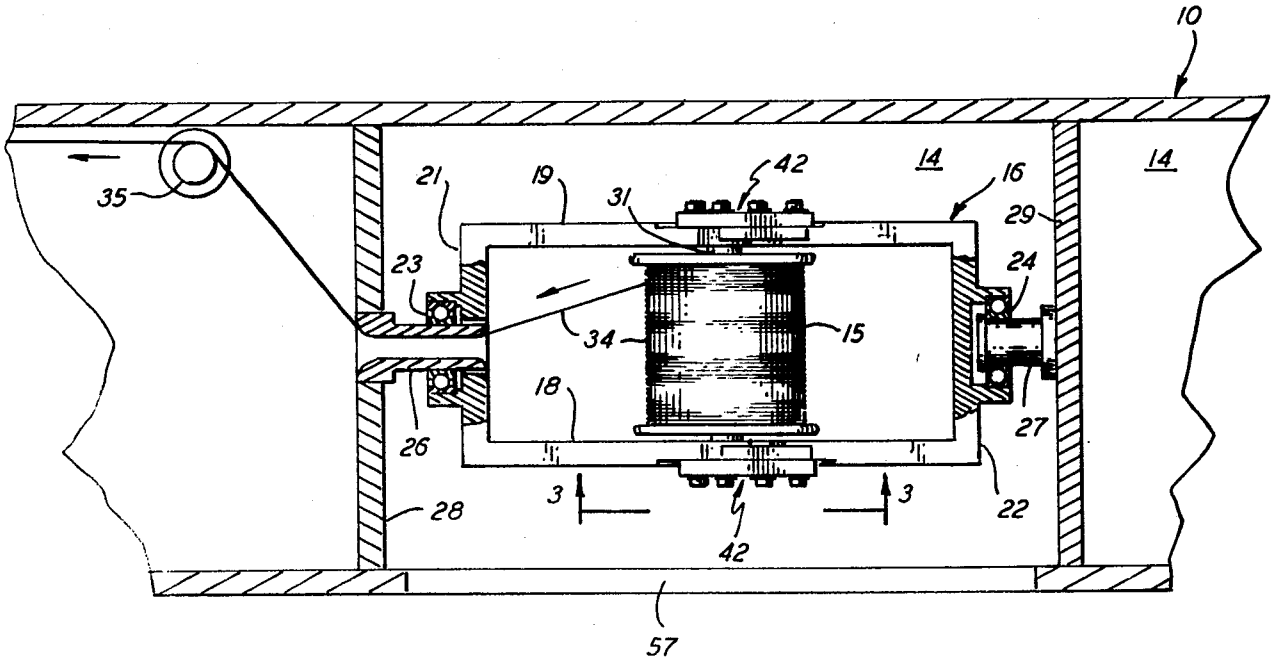
FIG. 2 is an enlarged horizontal section through one compartment of the machine of FIG. 1 showing one of the wire spools and its supporting cradle, certain parts being broken away to show details of the construction.

Each cradle 16 is in the form of an open rectangular frame, FIG. 2, having spaced side rails 18 and 19 connected together by end rails 21 and 22. The end rails are supported by bearings 23 and 24, and the inner races of these bearings are respectively carried by a hollow shaft 26 and a stub shaft 27. The shafts 26 and 27 are coaxial with the longitudinal axis of tube 10 and are respectively supported by the compartment end walls 28,29.

Figure 3:
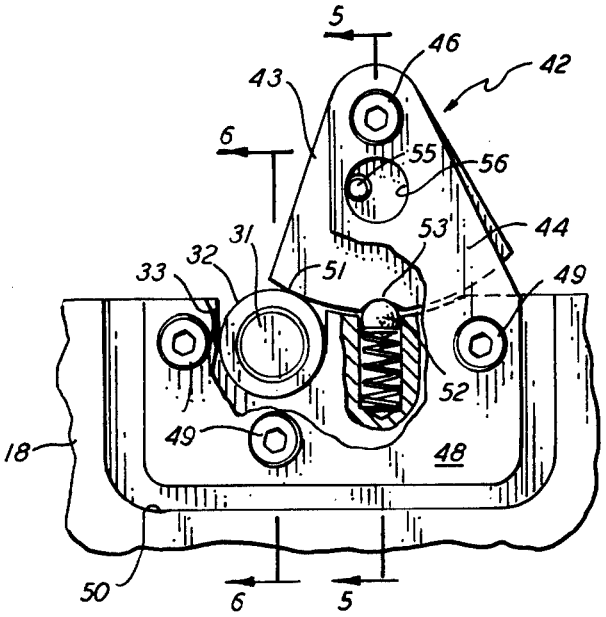
FIG. 3 is an enlarged elevational view of a portion of the cradle side rail and the lock mechanism of the invention looking in the direction of arrows 3—3 in FIG. 2, and with parts broken away to show details of the construction.

The spool 15 includes a shaft 31, FIGS. 2 and 3, the ends of which are received in needle bearings 32. The needle bearings are in turn received in oppositely disposed grooves 33 in the cradle side rails. The spool is thus rotatably mounted in its cradle and the spool wire 34 is drawn off the spool, through the hollow shaft 26 and from thence out to a pulley 35 mounted on the inside of the tube wall. In this connection, it should be noted that each cradle 16 is weighted at the bottom so that it remains stationary when the tube rotates.

The spool and cradle arrangement shown in FIG. 2 and just described is the same for each compartment 14 of the tube. The wires from all the spools are drawn to the left end of the tube 10, as viewed in FIG. 1, and on leaving the rotating tube are twisted together at a twister head 37 to form a stranded wire 38. The stranded wire is pulled at a uniform speed by a capstan 39 and then wound on a take up reel 40 all in a conventional manner.

Because the strander tube 10 typically rotates in excess of 2,000 R.P.M., it is imperative that the individual spools 15 be securely locked in their cradles 16. A failure that permitted a spool to escape from its cradle and contact the inside of the tube would result in very serious damage to the machine. In accord with the invention, a lock mechanism, generally indicated at 42, is provided that holds each spool in its cradle in a very secure manner.

Figure 5:
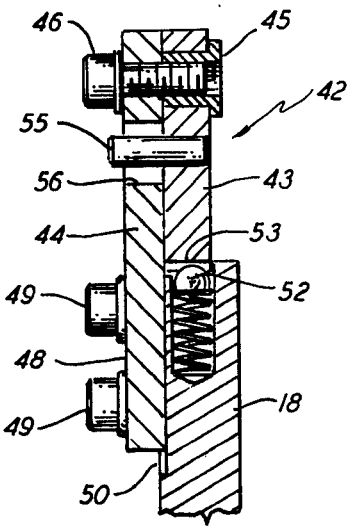
FIG. 5 is a fragmentary vertical sectional view taken on line 5—5 of FIG. 3.

There is a lock mechanism 42 for each end of each spool shaft 31 and since all are the same, only one need be described. Referring to FIGS. 3–6, the lock mechanism includes a generally sector shaped locking member 43 that is pivotally connected adjacent its upper or vertex end to a support member 44. As best shown in FIG. 5, the locking member 43 is pivotally mounted on a lock bushing 45 into which a bolt 46 extending through the support member is threaded.

The support member 44 has a base portion 48 that is secured to the cradle side rail 18 as by bolts 49, the base portion being positioned in a shallow recess 50 in the outside surface of the side rail. The support member base portion overlies the outer end of the spool shaft groove 33 so that when the locking member 43 is pivoted in the clockwise direction as viewed in FIG. 3, its lower, arcuate edge 51 will engage and overlie the spool shaft needle bearing 32 as shown in FIG. 3. This securely locks the shaft and spool in place on the cradle, and the locking member is held in locking position by a spring biased ball detent 52 that engages a mating recess or groove 53 in the arcuate edge of the locking member. It should be noted that an upward force on the spool shaft will not impart a rotational, unlocking force to the locking member because the engaging surfaces are both cylindrical.

Figure 4:
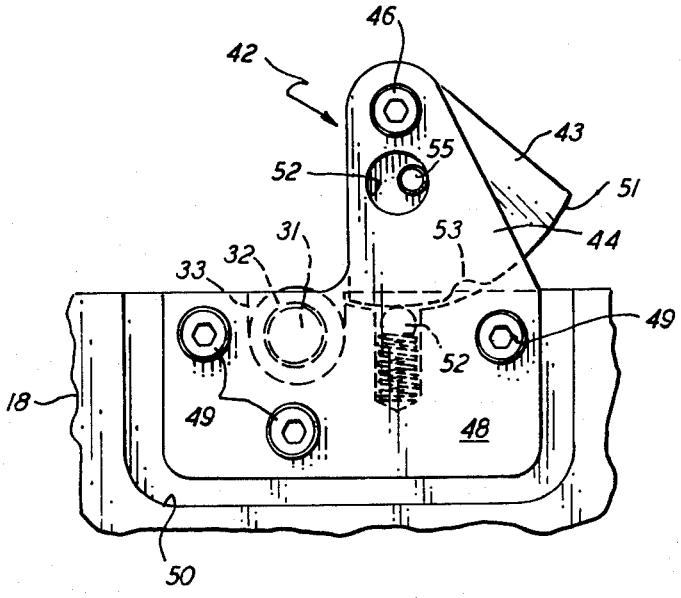
FIG. 4 is a view corresponding to FIG. 3 but showing the locking member in unlocked position.
Figure 6:
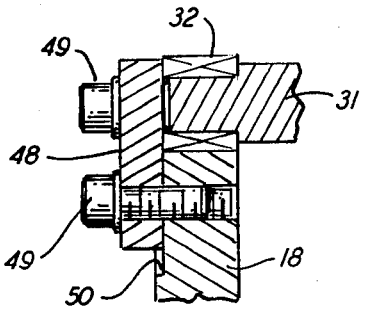
FIG. 6 is a fragmentary vertical sectional view taken on line 6—6 of FIG. 3.

As shown in FIG. 4, the locking member 43 can be pivoted in the counterclockwise direction, against the action of the ball detent, into its unlocked position whereby an empty spool can be removed from the cradle and replaced. The locking member is provided with means for limiting its movement to the two positions shown in FIGS. 3 and 4, this means consisting of a pin 55 that projects outwardly from the locking member, FIG. 5, into an oversized hole 56 in the support member 44. The hole 56 limits the movement of the pin and thus of the locking member to which it is secured.

The lock mechanism just described secures the wire spools in their cradles in a positive yet releasable manner but at the same time it provides a mechanism that is quick and easy to operate. For each tube compartment 14 there are access openings 57, FIGS. 1 and 2, through which the spool must be loaded and unloaded. The lock mechanism permits simple, one hand locking and unlocking in the limited space provided.

From the foregoing description it will be apparent that the invention provides a novel and advantageous lock mechanism for the spools of wire stranding machines. As will be understood by those familiar with the art, the invention may be embodied in other specific forms without departing from the spirit or essential characteristics thereof.

I claim:

1. In a wire stranding machine including a rotatable tube, a cradle non-rotatably mounted within the tube, and a spool having a support shaft rotatably mounted in the cradle, the cradle being in the form of an open rectangular frame having spaced side rails, the side rails having opposed grooves for receiving the ends of the spool shaft; the improvement comprising a lock mechanism for releasable securing the ends of the spool shaft in the cradle side rail grooves, the lock mechanism having for each end of the spool shaft a generally sector shaped locking member movable into and out of a position overlying the shaft end, and detent means engageable with the arcuate surface of the locking member to releasably hold the member in its shaft overlying position.

2. A lock mechanism as defined in claim 1 together with means to limit the movement of the locking member.

3. A lock mechanism as defined in claim 1 together with a support for the locking member mounted on its associated cradle side rail adjacent the shaft receiving groove therein, the locking member being pivotally connected adjacent its vertex to the support and being movable about said pivot point into and out of a position overlying the spool shaft end.

4. A lock mechanism as defined in claim 1 wherein the detent means is a spring biased ball detent mounted in the cradle side rail.

5. In a wire stranding machine including a rotatable tube, a plurality of cradles non-rotatably mounted within the tube, and a spool having a support shaft rotatably mounted in each cradle, each cradle being in the form of an open rectangular frame having spaced side rails, the side rails having opposed grooves for receiving the ends of its spool shaft; the improvement comprising a lock mechanism for positively yet releasably securing the ends of each spool shaft in their respective cradle side rail grooves, the lock mechanism having for each end of each spool shaft a support member secured to its associated cradle side rail adjacent the shaft receiving groove therein, the support member projecting above the top edge of the side rail, a generally sector shaped locking member pivotally connected adjacent its vertex to the support member whereby its arcuate side is movable into and out of a position overlying the spool shaft end, and detent means in the cradle side rail engageable with the arcuate side of the locking member to releasably hold the latter in its shaft overlying position.

6. A lock mechanism as defined in claim 5 together with coacting means on the locking member and support member to limit the movement of the former.

* * * * *